United States Patent [19]

Cobleigh et al.

[11] 4,345,497

[45] Aug. 24, 1982

[54] FILM SLITTER

[75] Inventors: Wendall C. Cobleigh; Donald L. Barmore; Robert C. Geschwender, all of Lincoln, Nebr.

[73] Assignee: Professional Marketing Associates, Lincoln, Nebr.

[21] Appl. No.: 188,532

[22] Filed: Sep. 18, 1980 (Under 37 CFR 1.47)

[51] Int. Cl.[3] ..... B26D 7/06

[52] U.S. Cl. ..... 83/105; 83/102; 83/407; 83/401; 83/425; 83/856

[58] Field of Search ..... 83/856, 407, 408, 425, 83/105, 102, 922, 401

[56] References Cited

U.S. PATENT DOCUMENTS

| | | | |
|---|---|---|---|
| 2,500,772 | 3/1950 | Reed | 83/105 |
| 3,489,043 | 1/1970 | Dent | 83/105 X |
| 3,789,713 | 2/1974 | Peters | 83/407 X |
| 4,059,037 | 11/1977 | Gerson et al. | 83/407 |
| 4,094,217 | 6/1978 | Exline | 83/856 X |
| 4,175,460 | 11/1979 | McPhail | 83/856 |

*Primary Examiner*—Donald R. Schran

*Attorney, Agent, or Firm*—Zarley, McKee, Thomte, Voorhees & Sease

[57] ABSTRACT

A film slitter is described including means for supporting a blade in an unexposed condition. The slitter comprises a support which is selectively slidably mounted on a supporting member. The support is provided with an elongated slot extending downwardly thereinto which is adapted to receive a blade in a vertically disposed position. A second slot extends downwardly into the upper end of the support and extends between the first slot and one side of the support member. A second slot extends downwardly into the upper end of the support at the other side of the first slot and extends between the first slot and the other side of the support. The lower ends of the second and third slots extend in diverging directions with respect to each other.

4 Claims, 6 Drawing Figures

FILM SLITTER

BACKGROUND OF THE INVENTION

This invention relates to a film slitter and more particularly to a film slitter wherein a cutting blade is positioned so that it is not expected.

Many film slitters have been previously provided but ordinarily include an exposed blade over which the film is passed to separate the film. One problem associated with such a film slitter is that the exposed blade poses a safety hazard in that the operator's hand or finger may come into contact with the blade during the slitting operation. A further disadvantage associated with the prior art film slitters is that uneven slitting operations are frequently experienced since adequate guide means for the film are not provided.

Therefore, it is a principal object of the invention to provide an improved film slitter.

A still further object of the invention is to provide a film slitter wherein a film slitting blade is maintained in an unexposed position.

A further object of the invention is to provide a film slitter including means for achieving uniform slitting operations.

A still further object of the invention is to provide a film slitter which may be easily movably mounted on a supporting member.

A still further object of the invention is to provide a film slitter which is economical of manufacture, durable in use and refined in appearance.

These and other objects will be apparent to one skilled in the art.

SUMMARY OF THE INVENTION

Figure 1:
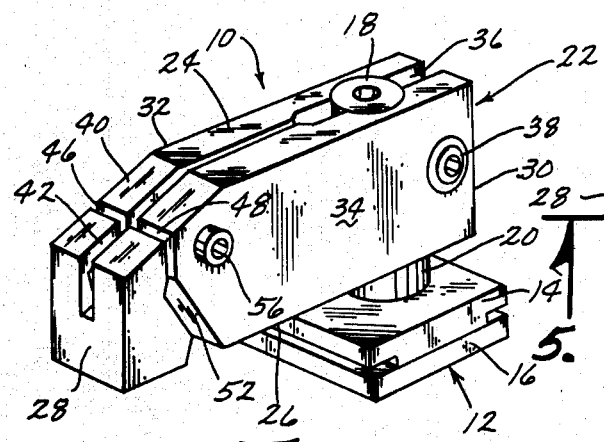
FIG. 1 is a front prospective view of the film slitter of this invention.

A film slitter is disclosed which is selectively slidably mounted on a supporting member. The slitter comprises a support means having a slitting blade mounted thereon in such a manner so that the blade is not exposed. A guide means is also provided on the support means to aid in guiding the film through the film slitter.

Description of the Preferred Embodiment

The film slitter of this invention is referred to generally by the reference numeral 10 and includes a quick-locking base including base plates (14) and (16). Cap screw (18) is mounted in base plates (14) and (16) and extends upwardly therefrom as illustrated. Pedestal (20) is positioned on the upper surface of base plate (14) and below support means (22).

Support means (22) is fashioned from a solid metal block member and is preferrably shaped so as to be generally rectangular including an upper end (24), lower end (26), outer end (28), inner end (30) and opposite sides (32) and (34). Support means (22) is slotted at (36) to enable support means (22) to be mounted on the cap screw (18). Support means (22) is maintained on the cap screw (18) by means of screw (38) in the manner illustrated in the drawings.

Figure 3:
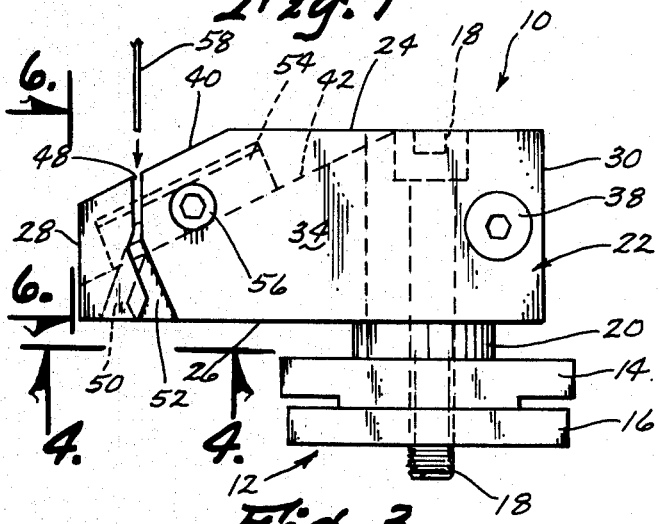
FIG. 3 is a side elevational view of the film slitter.
Figure 4:
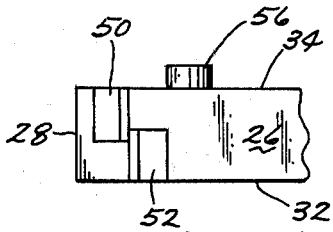
FIG. 4 is a sectional view as seen on lines 4—4 of FIG. 3.
Figure 5:
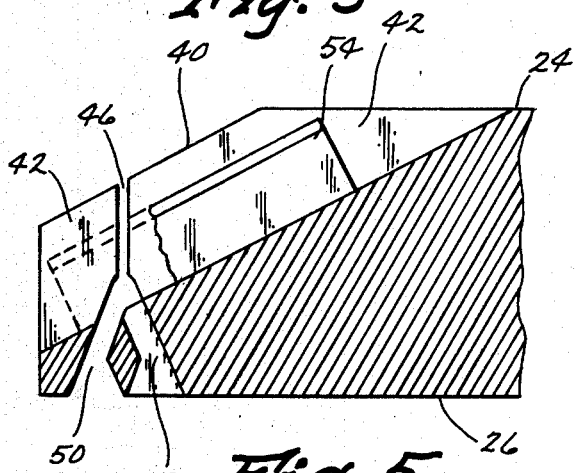
FIG. 5 is a sectional view as seen on lines 5—5 of FIG. 2.
Figure 6:
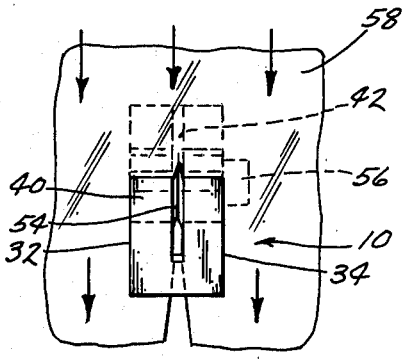
FIG. 6 is a sectional view as seen on lines 6—6 of FIG. 3.

The upper outer end of support means (22) is tapered or beveled at (40) as best seen in FIGS. 1 and 3. An elongated slot (42) is formed in support means (22) and extends downwardly thereinto as best illustrated in FIG. 5. Slot (42) terminates at (44) and it can be seen from the drawings that the lower end of the slot (42) is disposed at an angle with respect to the horizontal. Slot (46) is formed in support means (22) at one side of slot (42) and extends downwardly into support means (22) between slot (42) and side (32). Likewise, slot (48) extends downwardly into support means (22) between slot (42) and side (34). The lower end portion (50) of slot (46) extends downwardly and forwardly to lower end (26) as best illustrated in FIG. 5. The lower end portion (52) of slot (48) extends downwardly and rearwardly to lower end (26) as also seen in FIG. 5. The angular relationship of the lower end portions (50) and (52) is quite important inasmuch as there would be no way of supporting the outer end portion of the support means (22) if the lower end portions (50) and (52) were aligned.

The numeral (54) refers to a cutting or slitting blade which is positioned in the slot (42) so that its cutting edge is disposed below the upper end of the support means thereby eliminating the threat of injury to the operator's fingers or hand. Blade (54) is positioned so that the cutting edge thereof is in communication with the slots (46) and (48) and is held therein by means of screw (56). The numeral (59) refers to a limit pin extending upwardly from base plate (40) which is in the pivotal path of support means (22) to limit the clockwise rotation of support means (22) with respect to the base plate.

Figure 2:
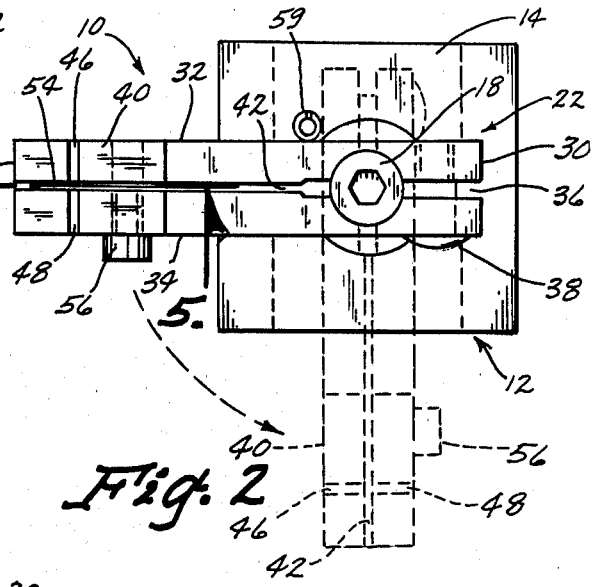
FIG. 2 is a top view of the film slitter of FIG. 1 with the broken lines indicating the support having been pivoted to its unlocked position.

Ordinarily, the base plates (14) and (16) would be slidably mounted on a suitable supporting member to enable the slitter to be selectively positioned along the length of the supporting member. The rotation of the support means (22) from the position illustrated by solid lines in FIG. 2 to the position illustrated by broken lines in FIG. 2 causes the separation of base plates (14) and (16) so that the unit may be moved along the length of the supporting member. When the support means has been properly positioned, support means (22) is rotated from the position illustrated by broken lines in FIG. 2 to the position illustrated by solid lines in FIG. 2 which blocks the base plates (14) and (16) onto the supporting member.

The film to be slit is generally indicated by the reference numeral (58) in FIG. 3 and is pulled downwardly into the slots (46) and (48) so that the film comes into contact with the cutting blade. Continued downward movement of the film (58) causes the slitting blade (54) to slit the film. The slots (46) and (48) serve to guide the film as it is passed over the cutting blade thereby achieving a very uniform and accurate slit in the film. As previously stated, the unexposed condition of the blade (54) prevents the operator from inadvertently engaging the same which does eliminate a serious hazard. The blade (54) may be easily changed as it becomes worn.

Thus it can be seen that a novel film slitter has been provided which accomplishes at least all of its stated objectives. Although the slitter of this invention has been described as being ideally suited for cutting or slitting film, it should be understood that the apparatus could be used to cut or slit anything capable of being passed downwardly through the slots (46) and (48) so as to come into contact with the blade.

We claim:

1. A film slitter, comprising, a support means having upper and lower ends, inner and outer ends and opposite sides, said support means having a central, disposed and elongated first slot formed therein extending downwardly thereinto from the upper end thereof and terminating above the lower end thereof, said first slot being positioned substantially equidistant from said opposite sides, said support means having a second slot formed therein extending downwardly thereinto from the upper end thereof and extending from said first slot to one of said sides, said support means having a third slot formed therein extending downwardly thereinto from the upper end thereof and extending from first slot to the other of said sides, the upper ends of said second and third slots being parallel and aligned, said second slot having a lower end portion which is angularly disposed with respect to the upper end portion of said second slot, said third slot having a lower end portion which is angularly disposed with respect to the upper end portion of said third slot, said lower end portion of said second slot extending towards one of said inner or outer ends of said support means, said lower end portion of said third slot extending towards the other of said inner or outer ends of said support means, said support means receiving a vertically disposed blade means in said first slot with the upper end of the blade means will be positioned below the upper end of said support means.

2. The slitter of claim 1 wherein the upper end of said support means adjacent one end thereof is tapered and wherein said blade means has one end thereof positioned in a plane below the other end thereof.

3. The slitter of claim 1 wherein said support means includes means at one end thereof for slidable connection to a supporting member.

4. The slitter of claim 3 wherein said means at said one end of said support means includes means for selectively locking said support means in various positions with respect to the supporting member.

* * * * *